United States Patent [19]

Mann

[11] 4,124,153

[45] Nov. 7, 1978

[54] TOOL FOR USE IN MAKING HOOKED RUGS

[76] Inventor: John J. Mann, 8015 Harwood Ave., Wauwatosa, Wis. 53213

[21] Appl. No.: 797,910

[22] Filed: May 18, 1977

[51] Int. Cl.[2] ..... D05B 85/00

[52] U.S. Cl. ..... 223/102

[58] Field of Search ..... 223/102, 103, 104; 66/117, 118; 128/339; 112/80

[56] References Cited

U.S. PATENT DOCUMENTS

| | | | |
|---|---|---|---|
| 1,592,897 | 7/1926 | Morton | 128/339 |
| 2,279,662 | 4/1942 | Denner | 223/102 |
| 4,047,397 | 9/1977 | Laliberte | 66/118 |

*Primary Examiner*—George H. Krizmanich
*Attorney, Agent, or Firm*—Ira Milton Jones

[57] ABSTRACT

An elongated tool for making hooked rugs has a handle at a rear end portion thereof and a small rearwardly-opening hook at its front end. A shank portion extends a distance rearwardly from the hook, and between this shank portion and the handle the tool has a lengthwise extending knife edge. Methods are described for using the tool with coarse-mesh and with fine-mesh base material to produce, in each case, a hooked rug having its tuft defining strands securely interwoven with the filaments of the base material.

3 Claims, 11 Drawing Figures

Fig. 1
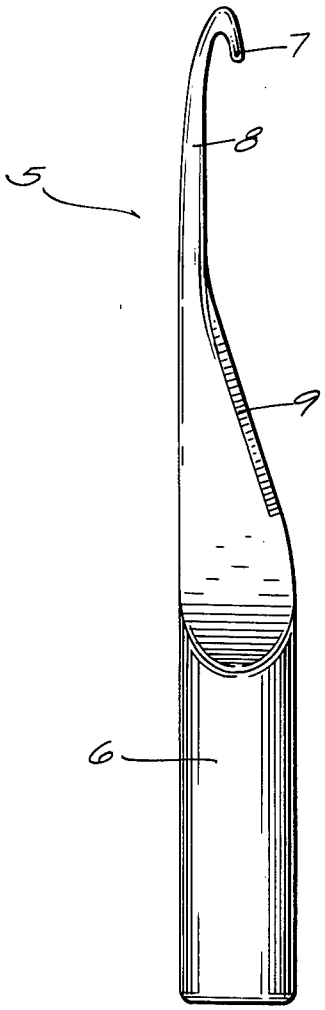
Fig. 2
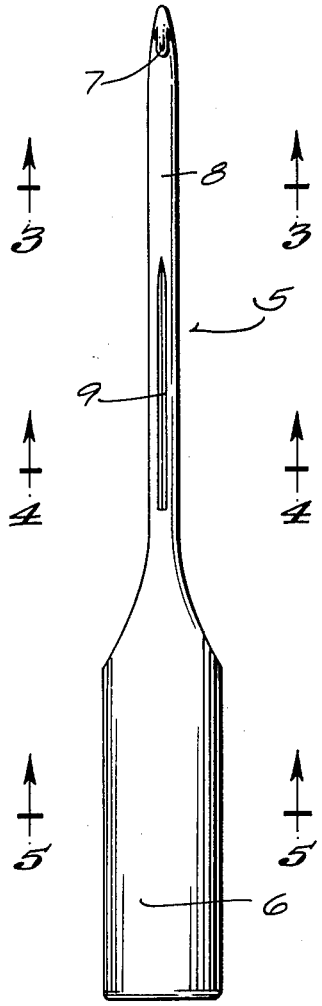
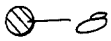
Fig. 3
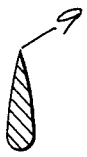
Fig. 4
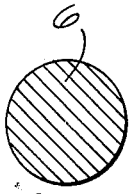
Fig. 5

TOOL FOR USE IN MAKING HOOKED RUGS

This invention relates to an improved tool for the making of hooked rugs, and the invention is more specifically concerned with an improved rug maker's hook that allows hooked rugs to be made by a method which is faster and easier than the method heretofore practiced with a latch hook but which produces a rug that is substantially superior in quality to rugs heretofore made with the use of a punch needle.

The making of a hooked rug is a manual craft by which yarn is looped around the filaments and through the interstices or holes of a net-like textile-fibre base. In the finished rug, tufts of yarn project up from the base at close intervals to present the appearance of a deep, soft pile. Variously colored yarns are usually used, to provide an attractive design on the surface of the finished rug. Base material pieces are often sold with color coding or other marking to define a design and to guide the selection of yarn color at each step of the process.

Two different tools have heretofore been available for use in looping yarn around the filaments of net-like base material. One of these, the latch hook, was employed with a coarse-mesh base having on the order of 3 ½ to 4 squares per inch. The other tool, the punch needle, was used with a relatively fine-mesh base material having about 10 or 12 squares per inch. Substantially different techniques were employed in the use of these respective tools.

A latch hook is an elongated tool having one end portion formed as a handle and its other end portion formed as a small hook that curves back towards the handle. In a shank portion of the tool, near the hook, there is a longitudinally extending slot in which one end portion of an arm or latch is pivotally secured. The latch can swing freely between open and closed positions. In its open position the latch projects toward the handle and lies closely adjacent to the shank of the tool; in its closed position a somewhat flattened tip portion on the latch overlies the tip portion of the hook and in effect closes the open mouth of the hook.

To accommodate its movable latch part, the operative portion of the latch hook must necessarily have some substantial size. Ordinarily the hook portion of the tool cannot pass through an opening smaller than about 3/16 in., and this limitation confines the tool to use with coarse-mesh base material.

In using the latch hook, its hook portion is woven under a filament of the base through two interstices or holes of the base, to dispose the shank of the tool under that filament of the base and over filaments parallel to said one filament that lie at opposite sides of it. The hook is advanced axially a substantial distance past the filament under which the tool is engaged, to carry the latch beyond that filament, and the latch is swung to its open position by its camming engagement with that filament as it passes the same. A short length of yarn (about 2 to 3 inches long) is looped under and around the shank of the tool, between its handle and the filament under which the tool was passed, and then the two end portions of the yarn loop are carried over that filament and into the bight of the hook. As the tool is drawn axially out from under the engaged filament of the base, the latch is cammed to its closed position, and the end portions of the yarn strand are thus held captive, to be drawn under the engaged filament and back through the bight of the loop of yarn that had embraced the shank of the tool. The ends of the length of yarn are then pulled up to establish the yarn in a securely knotted loop around the engaged filament, with the free end portions of the yarn strand projecting upwardly to provide two tufts of the rug. The hook is now woven in the same manner through the next adjacent pair of holes of the network, and the process just described is repeated to form another and adjacent loop of yarn, knotted around the same filament of the net-like base and providing another two tufts.

It will be apparent that the latch hook procedure is a relatively slow one, since each knotted loop requires that an individual short strand of yarn be separated from a store of such yarn pieces and separately attached to the base. The procedure also requires that the yarn either be purchased in precut lengths or be precut by the rug maker.

The method in which the punch needle is used can be practiced with a continuous length of yarn, and it is substantially faster than the latch hook method; but it requires that the network base be mounted on a frame, and it yields a rug of somewhat inferior quality to one produced by the latch hook method.

The punch needle has an elongated tubular tip through which a long strand of yarn is threaded. The outside diameter of the tubular tip is such as to fit closely in any of the holes of a fine-mesh base. To facilitate work with the punch needle, the base network is stretched on a frame and is usually oriented horizontally, with the surface of the base that is to be at the bottom of the finished rug facing upwardly, towards the rug maker.

As the punch needle tip is pushed axially downwardly through a hole in the base, an end portion of yarn, projecting from the hollow tip, is caught between its outer surface and the filaments that define the hole. Thus, as the needle is advanced through the hole, yarn is pulled through its long, tubular tip, to lie alongside the tip. A wide stop on the needle, near the handle of the tool, engages the network base to define the maximum distance to which the needle can be advanced through the base. When that stop engages the base, the needle is drawn back up, leaving a loop of yarn at the underside of the base. The needle is then moved to the next adjacent hole in the base and pushed down through it and withdrawn, and similarly through each of a row of holes in the base to form a loop of yarn at each hole, all loops being indentical because of the stop on the needle that determines the maximum extent of its advance. The tip of the needle is of course kept close to the base as it is moved from hole to hole. The loops can be left as loops, but more commonly every loop is cut through with a small scissors.

Cutting the loops divides the yarn into short strands, each comprising two tufts. Each strand has substantially a U-shape, being looped around one filament of the base, and each of its tuft-forming legs shares a hole in the base with a leg of an adjacent strand. Each strand is thus secured to the base mainly by its friction with the base and with adjacent strands. Therefore, if any significant amount of pull is exerted on an individual tuft, its strand can be drawn right out of the base, with the loss of two adjacent tufts from the rug, and with a loosening of its neighboring strands. If the loops are not cut through, a sustained upward pull on one loop can result in a whole row of loops being drawn off of the base.

Usually the underside of a rug made with a punch needle is coated with an adhesive that bonds the yarn loops to the base. The adhesive must of course be applied with care to avoid getting it onto the normally-seen portion of the rug. The adhesive coating is often covered with a fabric which is sewn to the base. Thus some of the speed of the punch needle method is offset by the time consumed in applying the adhesive and the backing fabric.

Because of its generally superior results and the fact that no frame is needed, the latch-hook procedure seems to have been practiced more widely than the punch needle method. However, it will be apparent that the latch hook method was slower, more laborious and more complicated than the punch needle technique, so that neither procedure has been entirely satisfactory.

The general object of the present invention is to provide a tool for use in the making of hooked rugs whereby a method can be practiced that combines the advantages of the two methods of hooked rug making that have been described above, said tool providing for the making of a hooked rug having its tufts well secured to its base and enabling such a rug to be quickly and easily made without a frame and without the need for precut lengths of yarn.

It is also a general object of this invention to provide a simple and inexpensive tool for the making of hooked rugs, which tool enables the rug maker to weave a continuous length of yarn through a net-like base in such a manner as to form loops that are securely interconnected with the filaments of the base, to cut the loops as quickly as they are formed, and to progress quickly from square to square of the base without the need for supporting the base on a frame.

Another object of this invention is to provide a versatile tool for making hooked rugs that is suitable for use with relatively coarse-mesh base materials intended for latch hook work and having on the order of 3 ½ to 4 squares per inch, and also for use with relatively fine-mesh base material intended for punch needle work and having on the order of 10 or 12 squares per inch.

A further object of this invention is to provide a very simple but versatile tool for use in the making of hooked rugs, which tool can be manufactured at very low cost and enables a hooked rug to be made without the use of auxiliary equipment, so that the rug maker need spend little more than the price of the materials actually incorporated in the finished rug in order to be fully equipped for making a hooked rug.

It is also an object of this invention to provide a method of making hooked rugs that can be practiced with either coarse-mesh or fine-mesh base material, which method is both fast and simple, requires no precutting of yarn, and results in good securement of yarn loops to the base material without the need for an adhesive.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention according to the best mode so far devised for the practical application of the principles thereof, and in which:

FIG. 1 is a plan view of rug hooking tool embodying the principles of this invention, shown somewhat larger than its actual size;

FIG. 2 is a side view of the tool;

Figure 6:
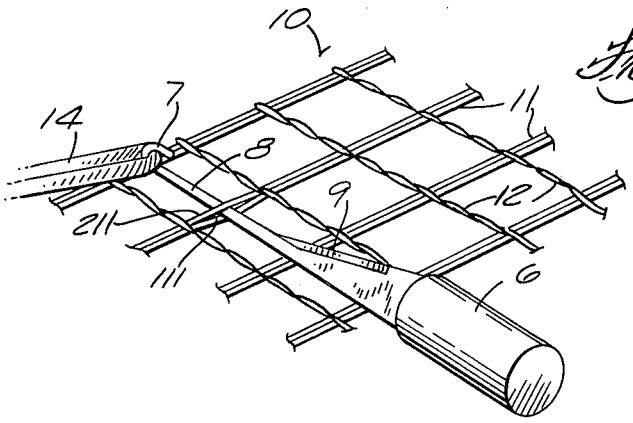
Figure 7:
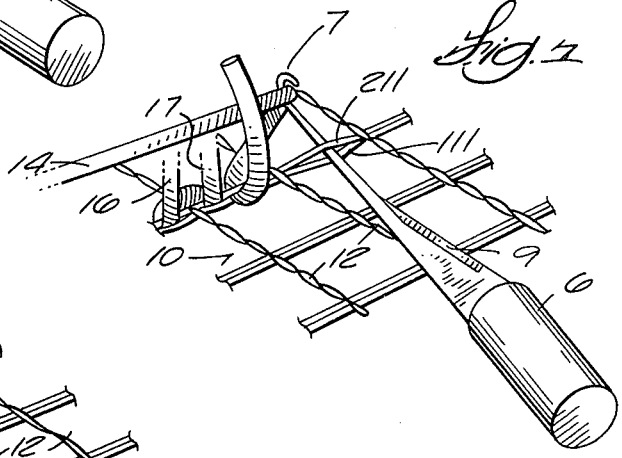
Figure 8:
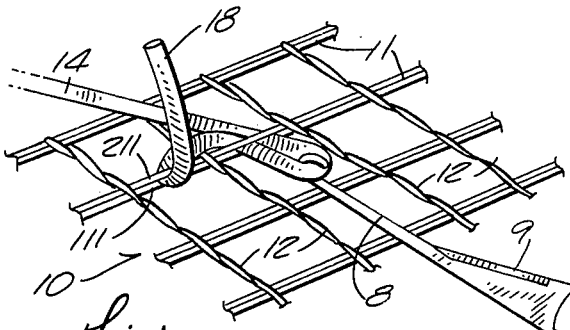
Figure 10:
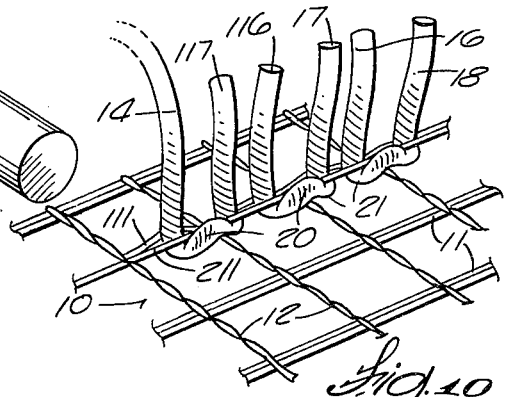
Figure 9:
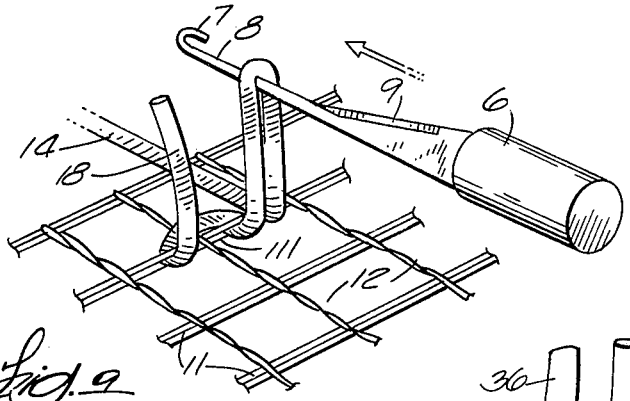
Figure 11:
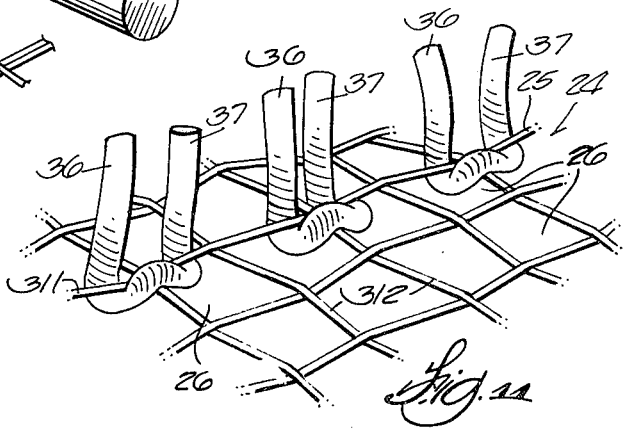

FIGS. 3 and 4 are views in cross-section, on an enlarged scale, respectively taken on the planes of the lines 3—3 and 4—4 in FIG. 2;

FIG. 5 is a view in cross-section taken on the plane of the line 5—5 in FIG. 1;

FIG. 6 is a perspective view illustrating an initial step in the method of using the tool of this invention with coarse-mesh base material;

FIGS. 7, 8 and 9 are views generally similar to FIG. 6 but illustrating further successive steps in the method of using the tool with coarse-mesh base material;

FIG. 10 is a more or less diagrammatic view illustrating how tuft-forming strands of yarn are interwoven with filaments of a coarse-mesh base in a rug made according to the method illustrated in FIGS. 6–9; and FIG. 11 is a view generally similar to FIG. 10 but illustrating how tuft-forming strands are interwoven with filaments of a fine-mesh base in a rug made on such base material with the tool of this invention, the base material being shown substantially larger than actual size.

Referring now to the accompanying drawings, the numeral 5 designates generally a rug-maker's tool which embodies the principles of this invention and which can be made in one piece from a suitable hard metal such as stainless steel. The tool 5 is an elongated instrument having one end portion shaped to provide a handle 6 and having its opposite end portion formed as a small hook 7 that opens toward the handle end. For reasons explained hereinafter, the hook 7 is substantially smaller than that of a conventional latch hook tool. Considering the hook as being at the front end of the instrument, a smooth and rather slender shank portion 8 extends a distance rearwardly from the hook. The length of this shank portion is on the order of ¾ inch. Note that the hook portion 7 extends laterally to only one side of the shank portion.

Between the handle 6 and the shank portion 8 the instrument has a knife edge 9, the length of which can be about 1 inch. The knife edge preferably faces in the same lateral direction that the hook extends.

The preferred technique for using the tool of this invention with coarse-mesh base material 10, such as is intended for latch hook work, takes advantage of the fact that such base material is woven with double filaments. In the base material 10 that is illustrated in FIGS. 6–10, parallel, untwisted double filaments 11 extend in one direction and can be considered the warp of the base 10, while twisted filament pairs 12 extend in the transverse direction and constitute the woof of the base material. In some coarse-mesh base materials untwisted filament pairs extend in both directions.

To begin the installation of a row of tufts on coarse-mesh base material 10, the front end of the tool 5 is inserted between the two filaments of an untwisted warp pair 11, pressing down on the first-encountered filament 111 of that pair to dispose it under the tool and to allow the tool to pass under the second-encountered filament 211 of that pair. The tool is axially advanced sufficiently to bring its shank portion 8 between the two filaments just mentioned, and it can be advanced far enough so that its hook portion 7 overlies the next forward pair of warp filaments.

The yarn 14 to be used can be in a skein of any desired length. Initially the yarn is engaged around the shank portion 8 of the tool, near the hook 7, at a point on the yarn that is about an inch or two from one end of the skein. The yarn is held looped around the tool under tension, extending laterally away from the tool shank 8 in one direction, and the tool is so oriented that its hook 7 extends laterally in the opposite direction. While the yarn is maintained under tension, it is slid forwardly along the tool until it is brought into the embrace of the hook 7 as shown in FIG. 6. Since the hook 7 must pass readily between the double filaments 11 of the warp, the mouth of the hook will be somewhat smaller than the normal diameter of most yarns, and tension is therefore maintained on the yarn, as just mentioned, in order to compress the yarn against the tool and ensure that all its fibres are brought into the embrace of the hook 7.

While tension continues to be maintained on the yarn, the tool is moved axially rearwardly to draw it back out of engagement with the base filament pair 111, 211 between which it has been inserted; and of course the loop of yarn that is engaged with the hook 7 is thus drawn through that filament pair, as illustrated in FIG. 8. (FIG. 8 depicts the presence of a "starter" tuft 18 produced by a preceding operation of the type now being described, or by a suitable starting operation.) The yarn loop is drawn out beyond the filament pair to a desired length, still maintaining some tension on the yarn, as shown in FIG. 9. As the loop is drawn out, the hook 7 can be disengaged from the yarn with a small axially forward motion of the tool, so that the yarn is engaged and drawn by the shank portion 8. When the loop of yarn has been drawn to the desired length, and while tension continues to be maintained on the yarn, a simple forward slicing movement of the tool (as denoted by the arrow in FIG. 9) brings its knife edge 9 into cutting engagement with the yarn and enables the loop to be cut through and thus formed into two tufts 16, 17. (See FIG. 10, and note that as shown in FIG. 10 the mesh base 11 is rotated edgewise through 180° relative to the position in which it is seen in FIGS. 6–9.) The tufts 16, 17 project upwardly from the warp filament pair 111, 211 between which they are confined and tend to be held upright by the filament pair.

The tool 5 is now inserted between the same untwisted filament pair 111, 211 in a square of the net that is adjacent to the one at which the tufts 16, 17 have just been made, such insertion being made exactly the same way as the previous one. When thus inserted, the hook 7 should be oriented to lie in a plane substantially parallel to that of the base and to project away from the two tufts previously made, as shown in FIG. 7. Now the skein of yarn 14 is swung around the shank portion 8 of the tool and then over and across the shank portion to be looped around it; and while the tool is slid axially rearwardly, the yarn is maintained under tension to be engaged in the hook portion 7. The tool is drawn back through the pair of warp filaments 111, 211 as before, to draw a new loop of yarn through those filaments substantially as shown in FIG. 8; and that loop is cut like the previous one to form two new tufts 116 and 117 (see FIG. 10) at the next square of the base. Note that the tuft 116 is continuous with the tuft 17, while the tuft 117 is continuous with the remainder of the skein of yarn. The tool is then inserted between the same pair of warp filaments at the next adjacent square, and the last-described operation is repeated.

Because there is no need to pick up and handle individual short lengths of yarn, and because the steps in the above described sequence flow smoothly into one another, a row of tufts can be formed about as quickly as in punch needle work.

As a row of tufts is formed, it will be seen that each tuft is continuous with a tuft in an adjacent square, and that each strand of yarn that comprises a pair of tufts is woven through the base in such a manner as to be securely connected to it. Specifically, the middle portion of each such strand overlies a twisted pair of woof filaments 12, as at 20 (see FIG. 10), dips down at each side of the woof filament pair to pass under the warp filament 211, as at 21, and passes upward between that warp filament and its adjacent one 111. Thus the two adjacent warp filaments 111, 211 cooperate with the twisted woof filament pair 12 to lock the strand securely in place. The yarn strands would of course be similarly secured to the base if the woof filaments 12 were untwisted and parallel to one another like the warp filaments. With a relatively slippery synthetic yarn, and with the exertion of a very substantial amount of tension on only one tuft, it is possible to disengage a strand of yarn from the base; but under ordinary conditions of use — and even under very rough use — each strand tends to remain securely locked to the base because of the manner in which it is interwoven with the filaments of the base material.

The fine mesh backing material 24 that is customarily used for punch needle work has single filaments 25 (see FIG. 11) that are interwoven to form a network resembling window screening, but it is of course made of cotton or similar textile fibre material. Because it is loosely woven, its woof and warp filaments are bonded to one another, at the points where they cross, by starch or a similar adhesive material with which the filaments have been impregnated. The adhesive bond between crossing filaments tends to be rather easily broken, and when the tool 5 of this invention is used with such fine mesh material it is assumed that certain of those bonds will in fact be broken. However, the yarn interwoven with the mesh filaments by the procedure now about to be described locks itself to the filaments and in turn locks the filaments to one anotherin such a manner that the mesh filaments are confined against displacement relative to one another and the network retains its integrity notwithstanding the breaking of many or most of the adhesive bonds between warp and woof filaments. In using the tool 5 of this invention with such fine-mesh base material, the hook 7 of the tool is inserted axially through one of the interstices or holes 26 of the network, under one of the filaments 311, and out through the adjacent hole, so that the tool is in effect caught under the one filament 311 and overlies other parts of the network. Although the warp and woof filaments of a fine-mesh material may be indistinguishable from one another in practice, the filament 311 under which the tool is engaged can be regarded as a warp filament for purposes of explanation. Such insertion of the tool under that warp filament will almost invariably break the bond between that warp filament and the woof filament 312 which is adjacent to the tool and which passes under that warp filament. While the tool is engaged under the warp filament 311, an end portion of a skein of yarn is looped around the shank portion 8 of the tool and, while being tensioned, is slid along the shank to be engaged in the hook 7, all as in the above described use of the tool with coarse-mesh base material.

While tension is maintained on the yarn, the tool is axially withdrawn from under the warp filament beneath which it has been engaged, bringing a loop of yarn with it. As before, the loop of yarn is drawn to a desired length, and is then cut through with the knife edge 9 on the tool to form two tufts 36 and 37 which project up through one and the same hole 26 in the base material. The tool is then moved to an adjacent hole at the opposite side of a woof filament 412 that passes over the warp filament 311; and the tool is then pushed under the same warp filament 311, to underlie that filament and overlie the rest of the net base as before. The skein of yarn is again engaged with the hook, as in working with coarse-mesh base, and the process of drawing and cutting a loop, as described just above, is repeated.

It will be apparent that each cut strand of yarn in the finished rug again defines two tufts 36, 37 that project up through adjacent holes. Tracing each strand of yarn from the top of a tuft 36 that it defines, it will be seen that the strand passes down under that warp filament 311, than loops up over the woof filament 412 that passes over said warp filament, then passes back down under the same warp filament 311 and extends back up to form the other tuft 37. Thus, as with coarse-mesh base, each strand is securely interwoven with the filaments of the base and is thus substantially locked to the base. It will be noted that each woof filament 412 which passes over a warp filament 311 is pressed down into secure engagement with that warp filament by the bight portion of a loop of yarn extending across it. For clarity, the yarn and the filaments of mesh material are shown much thinner than they would actually be. In an actual rug, each tuft of yarn would substantially fill a square between a pair of adjacent woof filaments and a pair of adjacent warp filaments, and the bight portion of the loop comprising a pair of tufts would similarly fill two such squares so that the filaments of the network base are confined against lateral relative displacement by the yarn interwoven with them. It will also be apparent that tufts project up through alternate rows of squares, inasmuch as the bights of the yarn loops occupy the intermediate rows of squares.

It will be evident that the small size of the hook portion 7 of the tool of this invention not only allows it to pass readily between the closely adjacent filaments 111, 211 of a double filament network warp but also enables it to pass through the relatively small holes 26 of a fine-mesh base material intended for punch needle work. However, if desired, a tool intended for use with fine-mesh base material can have a somewhat larger hook 7 than one intended for coarse-mesh base, so that it can more readily accommodate a thicker yarn. In any case it is preferred that the hook portion 7 have its exterior formed as a more or less blunt point to facilitate its insertion. In that respect, the exterior surface configuration of the hook portion, as seen in plan view (FIG. 1), can be a half ellipse, truncated at its minor axis and having its major axis parallel to the shank portion.

From the foregoing description taken with the accompanying drawings it will be apparent that this invention provides a very simple, inexpensive and versatile tool for making hooked rugs, capable of being used with either fine mesh base material such as is employed for punch needle work or with coarse mesh material such as is employed for latch hook work; and it will also be apparent that when used with fine mesh base material the tool of this invention eliminates the need for mounting such material on a frame and enables a more durable rug to be made, having its yarn more securely locked to its base than with prior rugs made by the punch needle process; whereas when used with coarse mesh base material the tool of this invention provides a faster and more convenient rug making procedure that avoids the need for individually handling short, precut lengths of yarn as was necessary with the latch hook technique.

Those skilled in the art will appreciate that the invention can be embodied in forms other than as herein disclosed for purposes of illustration.

The invention is defined by the following claims:

1. A rug maker's tool by means of which yarn can be looped around the filaments of a net-like base for the making of a hooked rug, said tool being characterized by:

A. an elongated body having one end portion thereof formed as a handle and having a hook at its other end which curves around to have its extremity project substantially towards the first-mentioned end of the body;

B. said body having a shank portion extending from said hook in the direction towards the handle; and C. said body further having a knife edge extending lengthwise therealong between said shank portion and said handle.

2. A tool to be used in making hooked rugs for looping yarn around the filaments of a net-like base, said tool being of the type comprising an elongated body having one end portion formed as a handle, characterized by:

A. the other end portion of said body being formed as a hook which opens in the direction towards said handle;

B. a portion of the body near said other end thereof being formed as a shank which is continuous with said hook and extends towards the handle therefrom; and C. said body having a knife edge extending lengthwise between said shank and said handle portions.

3. A tool for use in the making of hooked rugs and by means of which yarn can be looped around the filaments of a net-like base fabric, said tool having an elongated body with front and rear ends, the rear end portion of the body being formed as a handle, said tool being characterized by:

A. the front end portion of the body being formed as a substantially J-shaped shank, the curved portion of which provides a hook that has a rearwardly opening mouth; and B. said body having a knife edge extending lengthwise between its said shank portion and its handle portion.

* * * * *